US006983489B2

(12) United States Patent
Caprio

(10) Patent No.: US 6,983,489 B2
(45) Date of Patent: Jan. 10, 2006

(54) NURSING GARMENT AND SUPPORT BRA

(75) Inventor: Germaine Caprio, Oak Park, IL (US)

(73) Assignee: Raggle, Inc., Oak Park, IL (US)

( * ) Notice: Subject to any disclaimer, the term of this patent is extended or adjusted under 35 U.S.C. 154(b) by 390 days.

(21) Appl. No.: 10/068,194

(22) Filed: Feb. 5, 2002

(65) Prior Publication Data

US 2004/0016039 A1 Jan. 29, 2004

(51) Int. Cl.
*A61B 1/00* (2006.01)

(52) U.S. Cl. ..... 2/69; 2/106; 450/36

(58) Field of Classification Search ..... 2/105, 2/106, 104, 73, 78.1–78.4, 113, 114, 109, 2/110, 69, 243.1; 450/3, 5, 7, 8, 10–13, 15, 450/16, 18, 19, 20, 23, 30, 31, 36, 37, 54–57, 450/59–62, 65–67, 70

See application file for complete search history.

(56) References Cited

U.S. PATENT DOCUMENTS

| | | | | | |
|---|---|---|---|---|---|
| 232,246 | A | | 9/1880 | Duenckel | |
| 778,014 | A | | 12/1904 | Coyle | |
| 890,614 | A | | 6/1908 | Culver | |
| 2,624,049 | A | * | 1/1953 | Granne | 2/114 |
| 2,911,650 | A | | 11/1959 | Gerich | |
| 2,928,396 | A | | 3/1960 | O'Dell | |
| 3,611,439 | A | * | 10/1971 | Meyers | 2/114 |
| 3,746,007 | A | * | 7/1973 | Hand et al. | 450/31 |
| 4,208,743 | A | | 6/1980 | Whitcraft | |
| 4,440,174 | A | | 4/1984 | Cordova | |
| 4,648,404 | A | | 3/1987 | Clark | |
| 4,781,650 | A | * | 11/1988 | Budd | 450/55 |
| 4,878,879 | A | | 11/1989 | Kunstadter | |
| 5,024,628 | A | | 6/1991 | Sanchez | |
| 5,033,986 | A | | 7/1991 | Feigenbaum | |
| 5,103,501 | A | | 4/1992 | Meisels | |
| 5,182,813 | A | | 2/1993 | Booze | |
| 5,461,725 | A | | 10/1995 | Witczak | |
| 5,592,692 | A | | 1/1997 | Larson | |
| 5,611,086 | A | | 3/1997 | Eggen | |
| 5,848,439 | A | | 12/1998 | Huseth | |
| 6,015,331 | A | | 1/2000 | Ioakim | |
| 6,083,079 | A | | 7/2000 | Pearson | |

FOREIGN PATENT DOCUMENTS

| | | |
|---|---|---|
| WO | WO 02/30221 | 4/2002 |

* cited by examiner

*Primary Examiner*—Gloria M. Hale
(74) *Attorney, Agent, or Firm*—Leon I. Edelson; William C. Clarke; Levenfeld Pearlstein

(57) ABSTRACT

A nursing garment and support bra is provided as an outer body covering for a nursing mother suitable as a sleeping garment which provides support for the breasts and access to the breasts by a nursing infant, provides breast pad pockets to hold breast pads to contain flow from leaking breasts, or prostheses, provides two Vneckline breast retention panels easily slipped off the wearer's shoulder or pulled to one side to expose a breast for nursing by a nursing infant, and can function as a support bra for women who have undergone surgery and have use of a prosthesis.

11 Claims, 1 Drawing Sheet

NURSING GARMENT AND SUPPORT BRA

BACKGROUND OF THE INVENTION

1. Field of the Invention

The present invention relates to a nursing garment suitable as a sleeping gown and more particularly accommodates the need of a nursing mother for support of the bosom during sleeping and provides for absorption of fluid leaking from the breasts during the night. The present invention relates to a garment which provides support to the wearer but does not restrict movement of the wearer without the necessity of wearing a bra, thus alleviating the discomfort and restrictions of wearing a bra. The present invention also relates to a garment suitable as a support bra for women who have undergone mastectomies, lump-ectomies and breast reduction to provide a garment with needed support after these surgeries.

The invented garment functions as a bra replacement for women who have undergone mastectomies, lump-ectomies and breast reduction. Women who have undergone these procedures may wear the present invention as a support top and use it to give them the support needed after these surgeries without the discomfort of wearing a bra. The top supports the wearer but does not restrict movement of the wearer.

The pockets in the present invention allow a woman wearing it after breast surgery to place her prosthetic device right into the top, rather than needing a separate garment to hold her prosthesis. These pockets allow the wearer to place the prosthesis in either or both sides of the top allowing a comfortable and more natural look.

The present invention is designed in a full length or waist length as well as a shorter, midriff length. This allows the wearer to wear the garment(s) in all stages of her recovery. Most patients are not allowed to wear bras or any garments that cut under the bust line after surgery. The top in the waist length allows the wearer to feel the support of a bra but not be restricted under the bust line. Upon further recovery, the patient can utilize the top in the shorter length or midriff length allowing the wearer to return to a bra type garment and still not have the need to layer a prosthetic holding bra or device under her bra because the pockets are in the present invention as well.

The invented garment overcomes the problem that there are no garments currently available in the mastectomy or breast reduction clothing market that have pockets for the prosthesis, encompassing a design that gives support to the "good" breast. Also the garments that are on the market typically consist of a looser design that does not support either breast. The present invention supports the "good" breast and holds the prosthetic device close to the body of the wearer for a natural, more comfortable fit and effect.

The purpose of the garment is to provide sleepwear for a nursing mother and a support bra for women who have undergone surgery. The garment accommodates the need of a nursing mother for support of the bosom without the requirement for a nursing brassiere being a necessity for sleeping and nursing. The garment is unique in that the garment provides support to the woman's bosom without the constrictions of a nursing bra. The garment is comfortable enough to wear every day and all day, yet holds the bosom to the body with support at night during sleep. The garment eliminates the need to wear a nursing bra and a pajama top or pajama jacket to bed. This garment is unique in that the invented garment avoids the constrictions of a bra, yet provides the needed support for the bosom, accommodates the need for a nursing bra, and accommodates the need of the infant to nurse. The garment is unique in that it functions as a support bra for women who have undergone mastectomies, lump-ectomies and breast reduction.

Many women need more support than others so a large busted woman will need more support than a small-busted woman. After pregnancy and birth of a child, even a small-busted woman frequently will have a larger bust than before the pregnancy and birth. The instant invented garment provides the means to adjust the garment and provide the needed support for either a large busted woman or for the change in bust size as required by the woman's changing size from pregnancy to post delivery.

During periods of nursing, while the infant is nursing at one breast, the stimulation occasioned by the feeding infant at the one breast can result in flow from the other breast of the woman in what has been termed "leakage." The flow from the breast not in use can soak the woman's clothing and render the garments wet and uncomfortable to wear. The invented embodiment provides breast pad pockets to hold breast pads to contain leakage from the breasts.

The invented garment comprises a sleepwear garment for a nursing mother, the garment utilizing a fabric of a cotton blend with a stretch constituent fabric, spandex, the garment being designed as a shoulder supported garment of waist length with an elastic bias seam beneath the bust line and above the waist-length of the garment. Closure means of the upper overlays above the body-encircling bias seam is provided, the upper body overlays containing inside pockets for holding removable breast pads to contain breast leakage. The inside pockets can hold a prosthesis device if such is used.

The invented embodiment allows women to use breast pads if desired. If no breast pad is desired, the garment lies flat against the breasts and remains comfortable and supportive. A woman therefor can wear the garment in the invented embodiment long after the woman stops nursing. If breast pads are used for a few months and then discarded, the garment will return to a flatter shape and not hold the shape when breast pads were used. The invented garment with breast pad inserts in the breast pad pockets can be worn as a nursing garment and later as comfortable, supportive sleepwear and a support bra after the need for nursing has passed without the breast pad inserts. The invented embodiment allows women after breast surgery requiring a prosthesis to place the prosthesis device in the breast pad pockets of the garment rather than needing a separate garment to hold the prosthesis. The separate breast pad pockets allow the wearer to place the prosthesis in either or both sides of the garment to allow a comfortable and natural appearance without the discomfort of wearing a bra but with the support needed after surgery.

2. Description of the Prior Art

Many prior art nursing garments are known in the art to accommodate a nursing mother to nurse a child while wearing a garment. The prior art garments, however, tend to be directed to separate aspects of the problems a nursing mother encounters. For example, U.S. Pat. No. 5,848,439 relates to a nursing cape adapted to cover a mother's upper torso and drape over an infant while breast-feeding to provide a high level of privacy. U.S. Pat. No. 5,611,086 teaches a nursing garment which includes a vest which is attached to an undergarment which covers the upper torso of a nursing mother. The undergarment has a pair of openings through which the mother's breasts will protrude to permit nursing of a baby. Pockets formed in the vest on the inward side by a pair of flaps of liquid permeable material have liquid absorbent material inserted therein to absorb liquid which may leak from the nursing mother's breasts. The disposable or washable pads which fit therein and their use have been taught in the prior art. U.S. Pat. No. 5,592,692 discloses a garment which conceals a woman's breast while nursing and which can be worn over a wearer's existing clothing to allow a mother to nurse in public where access to privacy is unavailable. U.S. Pat. No. 5,461,725 provides a nursing garment with stretchable resilient support straps and a bodice. The straps are sufficiently resilient and stretchable so that the wearer can pull down the bodice to expose a breast for nursing, and when through, the wearer can return the bodice to its original position covering the breast. The bodice is V-necked and features a left cup and a right cup and is made to exhibit good horizontal stretch. The straps can be made of the same material as the bodice and can be of the same resilient and stretchable material. The bodice cups are formed by elastic shirring down the center of the bodice between the cups thus formed. A band below the cups serves to hold the bodice in place on the body of the wearer as well as to form the cups. Nursing pads or breast pads can be inserted between the material layers of the bodice and are removably secured. The cups support the breasts without a bra. In use, the wearer pulls down a cup to expose a breast, the cup being held under the breast by the contour and fold of the breast. The other breast remains in its cup. The garment can be of the empire style and reveal some breast cleavage to enhance the woman's figure.

Other prior art patents relate to similar related aspects of problems encountered by a nursing mother as to privacy and the need for nursing pads or the need to adjust her garment to feed an infant. U.S. Pat. No. 5,182,813 discloses a nursing garment having a pair of movable breast cover panels connected to opposite sides of an inwardly facing pleat face, the breast panels held in place by interior connections to conceal the wearer's breasts from view through the openings during normal wearing conditions. During nursing, the breast panels are moved through the slash opening of the pleat face to position the breast to allow the infant access to the breast. U.S. Pat. No. 5,103,501 discloses undergarments fabricated out of soft absorbent material. An undershirt has breast openings and nursing pads which cover the breast openings. The breast pads are removable to allow a woman to breast-feed a baby. U.S. Pat. No. 4,648,404 discloses a coordinated nursing slip and a nursing bra which can be worn separately or in combination. In combination, the slip bosom and the bra nursing flap open and close decorously as a unit to allow a mother to nurse her baby in semi-public surroundings with minimum social embarrassment. The nursing feature of the slip is invisible so that it could be worn as a regular slip after the nursing period is over. In use, the slip bosom and bra nursing flap are opened in unison to permit the mother to nurse. U.S. Pat. No. 4,208,743 discloses a gown for a mother to nurse an infant without partially disrobing. The gown is provided with two apertures, one on each side, essentially under each arm, each aperture so located that either breast can be exposed. The apertures are located to enable the mother to insert both hands at the same time to open a nursing type brassiere to nurse a child without opening the gown or exposing the body. U.S. Pat. No. 3,611,439 discloses a nursing gown with breast covering panels which can be dropped to expose either breast for the purpose of nursing.

None of the above inventions and patents, taken either singularly or in combination, is seen to describe the instant invention. Thus a nursing garment suitable as a sleeping gown and can function as a support bra for women who have undergone surgery, which particularly accommodates the need of a nursing mother for support of the bosom during sleep without the requirement for a nursing brassiere and provides for absorption of fluid leaking from the breasts during the night or from one breast when the infant is on the other breast is desired.

SUMMARY OF THE INVENTION

The invented garment a sleepwear garment for a nursing mother and a support bra for women who have undergone surgery. The garment utilizes a fabric of cotton blended with a stretch constituent, spandex, the garment comprising a shoulder supported garment of waist length with bosom support and retained shoulder slio-off front cross-over panels held in place by shoulder straps. The front shoulder straps and front panels have elastic straps incorporated therein for securing the shoulder straps and front panels in place over the breasts. The front shoulder straps and front panels are a single piece secured to the breast support seam of the garment. The breast support seam located below the breasts incorporates an elastic strap and is secured by the side seams of the garment back. An elastic stretch lace secures the garment around the body of the wearer. Each front panel includes a breast pad pocket, the pocket comprising a liner sewn into each front panel to hold a breast pad or prosthesis. Each panel liner embodying the pocket has an opening on the body side to provide access for the breast pad insert or prosthesis. The outer covering, the front shoulder straps and front panels, and the inner breast pad pocket liners are made of soft, stretchable natural, or synthetic fabrics or blends thereof. Preferably the garment is made of a fabric with stretchability.

DESCRIPTION OF THE INVENTION

In describing the preferred embodiments of the present invention, reference is made to FIGS. 1–4 in which like numerals refer to like features of the invention.

Figure 1:
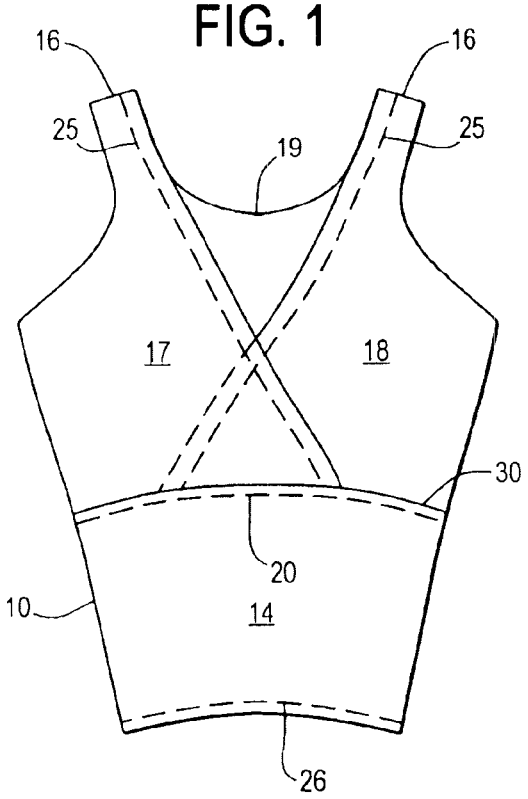
FIG. 1 is a front view of the preferred embodiment of the present invention with the elastic straps on the front panels, the breast support elastic strap and the elastic lace trim and hidden pockets shown in each panel.
Figure 2:
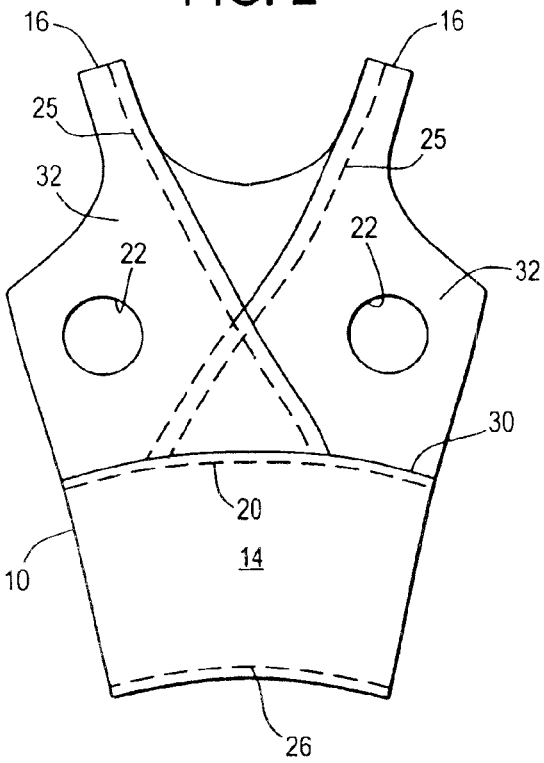
FIG. 2 is a cutaway of the present invention to show the body side breast panel pocket openings in each panel liner.

A front view of the preferred embodiment of the invention is depicted in FIG. 1. The sleepwear garment comprises an outer covering 10 consisting of two breast retention cross-over panels, 17 and 18, abdomen covering panel 14 and a back covering panel 12. The two cross-over breast retention panels 17 and 18 are constructed of angled side edges to form one side of the Vneckline and the bottom of the Vneckline is formed where the panels cross one over the other as shown in FIGS. 1 and 2. Panels 17 and 18 are joined to panel 14 by seam 20. Seam 20 is located above the waistline of the wearer of the garment and suitably below the breasts to cause the breast retention panels to support the undersides and sides of the breasts but do not otherwise restrict movement of the breasts by the wearer of the garment. Covering 10 extends below the arms and includes shoulder straps 16 as part of the breast retention panels. The outer covering 10 is made of a natural, synthetic or natural/synthetic blend fabric suitable for the desired end use such as spandex, nylon, polyester, cotton or blends thereof. The fabric should be soft, stretchable and resilient while still providing a moderate degree of support for the portion of the woman's torso, which it encases.

As shown in FIG. 1, the outer covering 10 encases at least the bust region of a woman's torso and covers the abdomen, hips and rear areas as well, those portions of a woman's torso conventionally covered by a woman's jacket. Alternatively, the outer covering 10 can comprise a full-length gown, which encases a woman's torso from the shoulders to below the knees with a full skirt for the wearer's comfort and ease of movement. The shoulder straps form a neck opening 19 and a pair of arm openings 35. The lower portion 14 of outer covering 10 covering the abdomen and the two breast retention panels 17 and 18, with v-necklines, are sewn or otherwise secured to the garment's back panel 12 along the side seams. The front panel covering the abdomen and the rear portion of the outer covering may be made of separate fabric panels in which case they are sewn or otherwise secured along side seams. Each breast retention panel, 17 and 18, comprises two layers of fabric, the inner layer 32 containing openings to insert breast pads, the outer layer furnishing the outer covering 10, the two layers sewn together to form a pocket therein, the inner layer 32 with an opening 22 on the body side to provide access for placement of a pad or prosthesis between the layers.

As shown in FIG. 1, each shoulder strap 16 of each breast retention panel which form the shoulder straps of the garment, there is an elastic strap 25 secured to each shoulder strap 16 joining the shoulder end of the shoulder strap to the seam 20 joining the breast retention panels and the abdomen covering panel 14. An elastic strap 30 is secured to seam 20 joining the breast retention panels 17 and 18 and the abdomen covering panel 14, the elastic strap 30 secured to the side seams joining the back panel 12 to the breast retention panels 17 and 18 and abdomen covering panel 14. The elastic straps are of a suitable elasticity to provide a measure of support to the undersides and sides of the breasts. Elastic lace 26 is secured to the lower portion of the abdomen covering panel 14 and the back 12 of garment 10 as a stretchable retention means for positioning and fitting the garment to secure the garment around the body of the wearer. The elastic lace 26 is of a sufficient elasticity to provide moderate stretch ability of the garment without high stretch ability. Alternatively, a hemline is secured to the lower portion of the abdomen covering panel 14 and the back 12 of garment 10 as a retention means for positioning and fitting the garment around the nursing mother's body.

FIG. 2 depicts the hidden breast retention liners of panels 17 and 18 with openings 22 providing entrance to the breast retention panel pockets formed within the panel between the outer covering and the liner. The openings 22 are suitably positioned to fit over each breast for positioning, a breast pad and prosthesis, and is, alternatively, in the form of a slit, a circular opening, an oval opening, and any modification of a slit opening, a circular opening, oval opening.

The breast pad pocket openings on each breast retention panel are suitably located that the breast pads and prosthesis are secured between the breasts and the breast retention panels, the breast pads and prosthesis being held between the two fabric layers of each breast panel, the fabric layers being soft stretchable and resilient of cotton with a stretch constituent, spandex, to hold the breast pads and prosthesis in place over each breast.

Figure 3:
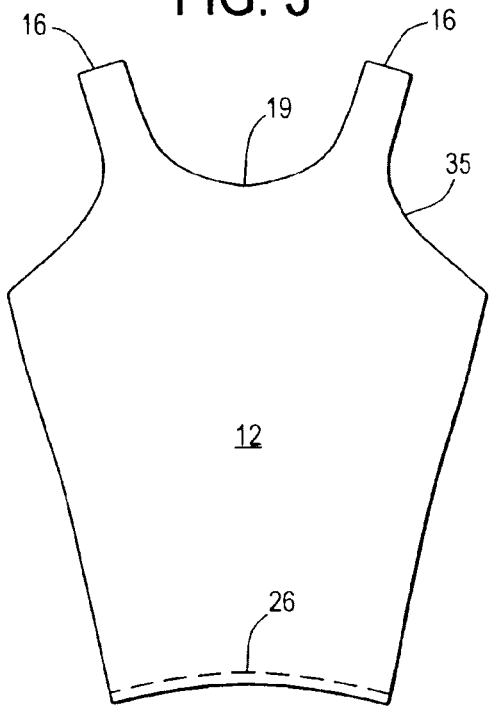
FIG. 3 is a view of a scoop back of the garment.

FIG. 3 depicts the rear view of the nursing garment with "scoop" style back shoulder neckline and shows the elastic lace 26 secured to the garment to secure the garment around the body of the wearer. The shoulder straps 16 define a conventional "scoop" back in which the neck opening 19 extends to about the shoulder blades.

Figure 4:
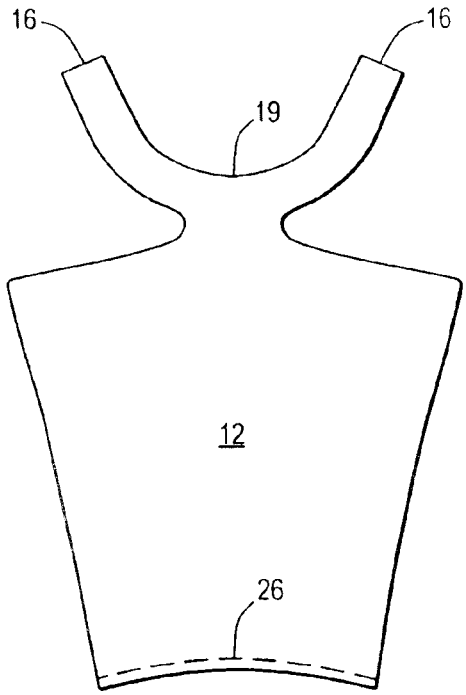
FIG. 4 is a view of a "T" style, or racer style, back of the garment.

FIG. 4 depicts the rear view of the nursing garment with alternative "T" style shoulder straps or a "racer" back to provide added support to women who need such. In the alternative style shown, the shoulder straps 16 define the "T" style back in which the neck opening 19 does not extend down the back of the wearer but is higher up on the back and closer to the neck line while the arm openings 18 extend well into the back of the wearer. Any other type of construction along the back region of the garment may be utilized to provide support to the bosom of the wearer but such construction should provide cross support as high as possible and preferably no lower than just below the bust line.

Turning again to FIG. 1, the view depicts that the nursing garment embodies a Vneckline. This allows the nursing mother to slide either shoulder strap off her shoulder to nurse her child. The Vneckline in the front of the garment allows the woman to easily slip the shoulder strap and breast retention panel down so that there is no need to fumble with hooks or clasps in the middle of the feeding period. One breast remains covered while the other breast is used. In an alternative embodiment, there is no need for the woman to be concerned about soaking the garment while nursing the baby because the breast pads stay in place by the stretchability and elastic support provided by the stretchable materials of the fabric layers of the panels and can absorb fluid from the breast not being used for nursing. The breast pads, remaining in place, also absorb fluid from both breasts after the nursing period if fluid continues to flow.

Referring to FIG. 2, the breast pad pocket openings 22 depicted are hidden on each breast retention panel 17 and 18 by outer covering 10. The breast pad pocket openings are positioned on each panel 17 and 18 in suitable position over each breast, each opening to receive and hold a breast pad or prosthesis. The dimension of the opening can be sized to allow breast pads of any suitable size to be held in place by the stretchability and elastic support provided by the stretchable materials of the fabric layers of the panels. The breast retention panel inner layers are fashioned of the same material as throughout the garment but it is understood that variations in fabric used for the inner layers and the dimensions of the opening are possible without departing from the spirit and scope of the invention.

Essential elements of the garment comprise the two Vneckline breast retention panels which are easily slipped off the wearer's shoulder to expose a breast, and the three elastic straps which hold the garment in place on the wearer as shown in FIGS. 1 and 2. Two straps 16 are secured to the Vnecklines of the breast retention panels 17 and 18. The third breast support elastic strap 20 is located below the bosom and secured to the side seams joining the breast retention panels to the back panel. The breast support elastic strap 20 is also secured to the seam joining the two breast retention panels to the abdomen-covering panel. An additional essential element comprises the elastic lace strap, which encircles the wearer at the base of the garment and serves to hold the garment in place around the torso of the wearer. The fabric comprising the garment is an additional essential element being a cotton blend with a stretch constituent which provides stretchability with recoverability, is soft to the touch, and supportive to the wearer's body. The Vneckline design of the garment as in FIGS. 1 and 2 is a further essential element of the garment 10 in that the separate breast panels comprising the Vneckline permit the wearer to slip a breast retention panel and shoulder strap off her shoulder at the wearer's convenience without undoing straps, hooks, buttons, or clasps, and to readjust the breast retention panel and shoulder strap back upon her body to the panel's original breast covering position with ease.

An alternative embodiment of the invented garment can comprise a full-length gown or dress which encases a woman's torso from the shoulders to below the knees with a full skirt for the wearer's comfort and ease of movement. An alternative embodiment of the dress can comprise the back of the dress having a center seam running from the center back below the neck opening 19 of the gown to the center of the waist of the gown to provide a fitted back to the garment if such is desired.

While the fabric used in the garment may be of the same type throughout the garment, the constituents of the fabric may be selected to provide degrees of softness, stretchability, and support to the wearer's torso as desired to increase the wearer's comfort and support needs. While this invention has been described with reference to specific embodiments, it will be recognized by those skilled in the art that variations are possible without departing from the spirit and scope of the invention and that it is intended to cover all changes and modifications of the invention disclosed for the purpose of illustrations which do not constitute departure from the spirit and scope of the invention.

What is claimed is:

1. A nursing garment and support bra as an outer body covering for a nursing mother suitable as a sleeping garment and support bra which provides support for the breasts and access to the breasts by a nursing infant, which nursing garment and support bra, in combination, comprising:

two cros-over shoulder supported shoulder slip-off breast retention panels with Vnecklines and elastic straps incorporated therein;

an abdomen covering panel;

a back covering panel;

the two cross-over-shoulder supported shoulder slip-off breast retention panels secured to the abdomen-covering panel by a seam joining the said two breast retention panels to said abdomen covering panel to form a Vneckline opening, each said cross-over breast retention panel constructed of an angled side edge to form one side of a Vneckline, each said panel crossing over the other, the two cross-over shoulder supported shoulder slip-off breast retention panels are attached to the back panel to form right and left coverings for the right breast and left breast of the nursing mother, each shoulder supported shoulder slip-off breast retention panel secured to a top of the back covering panel to form shoulder support of the garment;

each cross-over shoulder supported shoulder slip-off breast retention panel comprising two fabric layers, a first fabric layer as an outer panel covering, a second fabric layer as a liner for the first fabric layer and, each second fabric layer containing an opening positioned over each breast;

each cross-over shoulder supported shoulder slip-off breast retention panel containing an elastic strap positioned on the Vneckline of each shoulder supported shoulder slip-off breast retention panel from the shoulder of each said breast retention panel to the seam securing each breast retention panel to the abdomen covering panel;

said elastic strap positioned on said Vneckline and secured to said seam securing each cross-over shoulder supported shoulder slip-off breast retention panel to the abdomen panel below the breasts, and secured to each side seam of the back covering panel at the left and right sides of the garment;

the abdomen covering panel secured to each side of the back covering panel to form a body covering garment in conjunction with said two cross-over shoulder supported shoulder slip-off breast retention panels and;

means to secure the bottom edges of the abdomen covering panel and the joined back covering panel as a retention means for positioning and fitting the nursing garment and support bra around the nursing mother's body.

2. The nursing garment and support bra of claim 1 wherein the two fabric layers of said two cross-over shoulder supported shoulder slip-off breast retention panels are joined with, the fabric layer on the body side of each said breast retention panel having an opening.

3. The nursing garment and support bra of claim 1 wherein the garment is made of a natural, synthetic or natural/synthetic blend fabric, which is soft, stretchable, and resilient, providing a moderate degree of support for the portion of the woman's body which it encases.

4. The nursing garment and support bra of claim 1 wherein the fabric of the garment is selected from the group consisting of spandex, nylon, polyester, cotton and blends thereof.

5. The nursing garment and support bra of claim 1 wherein the back covering has "scoop" style shoulder straps to define a conventional back neck opening wherein the back neck opening extends to about the shoulder blades and the arm opening is defined by the garment's shoulder straps.

6. The nursing garment and support bra of claim 1 wherein the back covering is defined with "T" style shoulder straps, the neck opening does not extend down the back of the wearer, is high up on the back and close to the neck line, and the arm openings extend into the back of the wearer sufficiently to provide support to the bosom of the wearer.

7. The nursing garment and support bra of claim 1 wherein said outer body covering encases a woman's torso.

8. The nursing garment and support bra of claim 1 wherein the back of the garment from the center back below the neck opening of the garment to the bottom hem line of the garment, comprises a fitted back.

9. The nursing garment and support bra of claim 1 wherein said means secured to the bottom edges of the abdomen covering panel and the joined back covering panel as a retention means for positioning and fitting the garment around the nursing mother's body comprises an elastic lace of a sufficient elasticity to provide moderate stretchability without high stretchability.

10. The nursing garment and support bra of claim 1 wherein said means to secure the bottom edges of the abdomen covering panel and the joined back cover panel for positioning and fitting the garment around the nursing mothers body comprises a hem line secured to the bottom edges of the abdomen covering panel and the joined back covering panel.

11. The nursing garment and support bra of claim 1 wherein said opening is positioned to fit over each breast for positioning, a breast pad and prosthesis, and is, in the form of any one of a slit, a circular opening, an oval opening or combination thereof.

* * * * *